US005944624A

United States Patent [19]

Davis et al.

[11] Patent Number: 5,944,624

[45] **Date of Patent: *Aug. 31, 1999**

[54] NOTCHED, SLOTTED GROMMET FOR SPORTS RACQUET

[75] Inventors: Stephen J. Davis, Washington Crossing, Pa.; Joseph J. Wolverton, Lawrenceville, N.J.; William Harvie, III; Brian J. Blonski, both of Yardley, Pa.

[73] Assignee: Prince Sports Group, Inc., Bordentown, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,881

[22] Filed: Sep. 23, 1997

Related U.S. Application Data

[63] Continuation of application No. 08/772,411, Dec. 23, 1996, abandoned.

[51] Int. Cl.[6] ..... A63B 51/10

[52] U.S. Cl. ..... 473/539; 473/522

[58] Field of Search ..... 473/520, 521, 473/522, 539

[56] References Cited

U.S. PATENT DOCUMENTS

| | | | |
|---|---|---|---|
| Re. 34,420 | 10/1993 | Darling . | |
| 1,665,598 | 4/1928 | May . | |
| 2,542,661 | 2/1951 | Godfrey | 473/539 |
| 3,930,648 | 1/1976 | Brown | 473/539 |
| 4,204,681 | 5/1980 | Hall, Jr. et al. | 473/539 |
| 4,309,033 | 1/1982 | Parker, Jr. et al. . | |
| 4,333,649 | 6/1982 | Vaughn et al. . | |
| 4,741,531 | 5/1988 | Szedressy . | |
| 4,889,337 | 12/1989 | Todd | 473/522 |
| 4,930,778 | 6/1990 | Mizuno . | |
| 4,949,968 | 8/1990 | Korte-Jungermann . | |
| 4,993,711 | 2/1991 | Deville et al. | 473/522 |
| 5,014,987 | 5/1991 | Soong . | |
| 5,137,274 | 8/1992 | Soong | 473/539 X |
| 5,290,031 | 3/1994 | Natsume | 473/539 X |
| 5,332,213 | 7/1994 | Klose . | |
| 5,368,297 | 11/1994 | Liu | 473/539 |
| 5,458,331 | 10/1995 | Bothwell | 473/539 X |

*Primary Examiner*—William E. Stoll
*Attorney, Agent, or Firm*—White & Case L.L.P.

[57] ABSTRACT

A sports racquet includes grommet members anchoring the strings in at least the central regions of the string bed which include grommet pegs which have grommet holes that, in cross-section, are elongated in a direction perpendicular to the string bed, and preferably include notches at their distal end. The slotted grommets and notches allow the strings to deflect, in a direction perpendicular to the string bed, upon ball impact. The strings are anchored only outside of the frame proper, and their effective string length is thus substantially increased. Preferably, the grommet members include a concave lip to act as a string guide, adjacent the grommet hole entrance to prevent string movement as it enters the slot. Preferably, the sidewalls of the grommet holes are spaced slightly farther apart than the width of the string so that the string can deflect freely upon ball impact with the string bed. The string hugs one of sidewalls, however, so that vibrations are damped after the ball has left the string bed.

10 Claims, 3 Drawing Sheets

NOTCHED, SLOTTED GROMMET FOR SPORTS RACQUET

This application is a continuation of U.S. application Ser. No. 08/772,411, filed on Dec. 23, 1996, now abandoned.

FIELD OF INVENTION

The present invention relates to sports racquets, for example, tennis racquets, squash racquets, badminton racquets, and racquetball racquets.

BACKGROUND OF THE INVENTION

In sports racquets having composite frames, the ends of the strings forming the string bed are secured in holes formed in the racquet frame walls. The strings, after crossing the string bed, pass through one string hole, are directed along the outside of the frame to the next string hole, and thereafter reenter the string bed area through the second string hole.

At the points where the strings enter and exit the string holes on the outside of the frame, the strings bend sharply. In order to prevent the composite material from damaging the strings, or vice-versa, it is customary to provide plastic grommet strips along the sides of the frame, and a plastic bumper strip in the tip region of the racquet. The grommet sleeves and bumper strip both have a strip portion that extends along the outside of the frame, and a plurality of hollow grommet pegs that extend through the string holes in the frame. In this manner, the strings, when passing through the string holes and along the outside of the racquet, contact the plastic grommet strip or bumper strip rather than the composite frame.

The grommet strips are normally disposed in a stringing groove formed in the outside surface of the frame. The bumper strip includes a center portion, which is the same as the grommet strip and that is disposed in the stringing groove, but also includes a pair of wings that project laterally from the center portion to overlie the outwardly facing surfaces of the frame, and thereby protect the frame surface from impact damage from impact, e.g., with the ground.

A racquet's power and sweet spot size are related to the length of the string used. Thus, an oversized racquet, such as disclosed in Head U.S. Pat. No. 3,999,756, increases the racquet's power and sweet spot size, because the strings are longer than in prior small head racquets, deflect more at impact, and reduce the compression of the ball at impact (which reduces energy loss). If the energy lost at ball impact can be reduced or conserved, more energy can then be returned to the ball via the strings and more power results from the hit.

While increasing a racquet's head size increases power, many players feel that racquets with large head sizes have less maneuverability, since the larger head size results in a larger polar moment of inertia. Although a larger polar moment of inertia is desirable in certain respects, because it increases the size of the sweet spot and reduces the tendency of the racquet to twist should the ball land other than along the centerline of the string bed, thereby making the racquet more stable, some players feel that it makes it harder to pronate the racquet for making effective spin shots and serves. It therefore would be desirable to increase the effective length of the strings without increasing the size of the head.

When a ball impacts the string bed, the strings are deflected in a direction perpendicular to the string bed. The opposed ends of each string bend about the grommet pegs, i.e., at the point where they exit the grommet peg and enter the string bed, which is adjacent the inside wall of the frame. Therefore, the effective string length is the distance between opposed walls at the location where each string spans the string bed.

Soong U.S. Pat. No. 5,014,987 discloses a racquet in which the string holes on the inside wall of the frame are greatly enlarged, so that the string can deflect freely. In such manner, the strings are secured only in the outside wall of the frame, and the effective string length is the distance between opposed outside walls, not the distance between the inside walls. Klose et al. U.S. Pat. No. 5,332,213 employs the same concept of enlarging the string hole on the inside wall of the frame to allow the string to deflect freely. However, instead of eliminating the grommet peg on the frame's inside wall, Klose et al. propose increasing the height of the grommet hole towards the inside of the frame.

As strings become longer and therefore more resilient, they tend to vibrate longer, and with a greater amplitude, after the ball leaves the string bed. String vibration is annoying to players, and therefore a number of methods have been proposed to damp string vibration. For example, Davis U.S. Pat. No. 4,828,259 discloses a tennis racquet with a double bridge in the throat region, that contains a vibration-dampening bar that damps both string vibrations and racquet frame vibrations. Davis et al. U.S. Pat. No. 5,211,397 discloses a vibration dampening member that engages the string bed for damping vibration. However, it is generally more preferable where possible to have a built-in vibration damping system such as in the '259 patent.

SUMMARY OF THE INVENTION

A grommet member according to the invention comprises a grommet strip portion and a plurality of grommet pegs, each having a first end extending from the grommet strip portion and a distal end opposite the first end. An axially oriented grommet hole extends through each grommet peg member which hole, at least along a part of said hole extending from the distal end towards the first end, has a cross-section that, in a direction perpendicular to the string bed, is substantially larger than the diameter of a standard sports racquet string.

In accordance with the invention, the grommet peg has a pair of opposed notches extending from the distal end towards the first end. The notches lie in a plane perpendicular to the string bed and which contains the grommet axis, and have a width which is at least substantially that of a standard racquet string.

The grommet hole, in a direction parallel to the string bed, has opposed sides which are preferably spaced apart a distance slightly more than the diameter of a standard racquet string. Due to the tension on the string, it tends to hug one side of the grommet hole, namely, the side where it enters. As a result, the string is free to move perpendicular to the string bed when a ball impacts the strings, but after the ball leaves the string bed, the contact between the vibrating string and the one sidewall generates friction and thereby damps vibration.

In a preferred embodiment, a grommet member having a plurality of notched, slotted grommet pegs is disposed on each side of the head portion of a sports racquet, such as a tennis racquet. The grommet members are preferably positioned in the center region of the head, where the string holes provided in the racquet frame are generally aligned with the direction of the strings as they cross the string bed. Another pair of grommet members having a plurality of notched, slotted grommet pegs, are disposed in the tip region and in the throat bridge, respectively, again where the string holes are aligned with the direction of the strings. The grommet member in the tip region may be disposed in a cutout formed in a conventional bumper strip.

If the string holes are drilled normal to the outside of the frame, the corner regions of the head, where the string holes lie at an angle relative to the direction of the strings as they cross the string bed, may be provided with conventional bumper and grommet strips. Alternatively, the entire racquet head may be provided with slotted grommets according to the invention.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
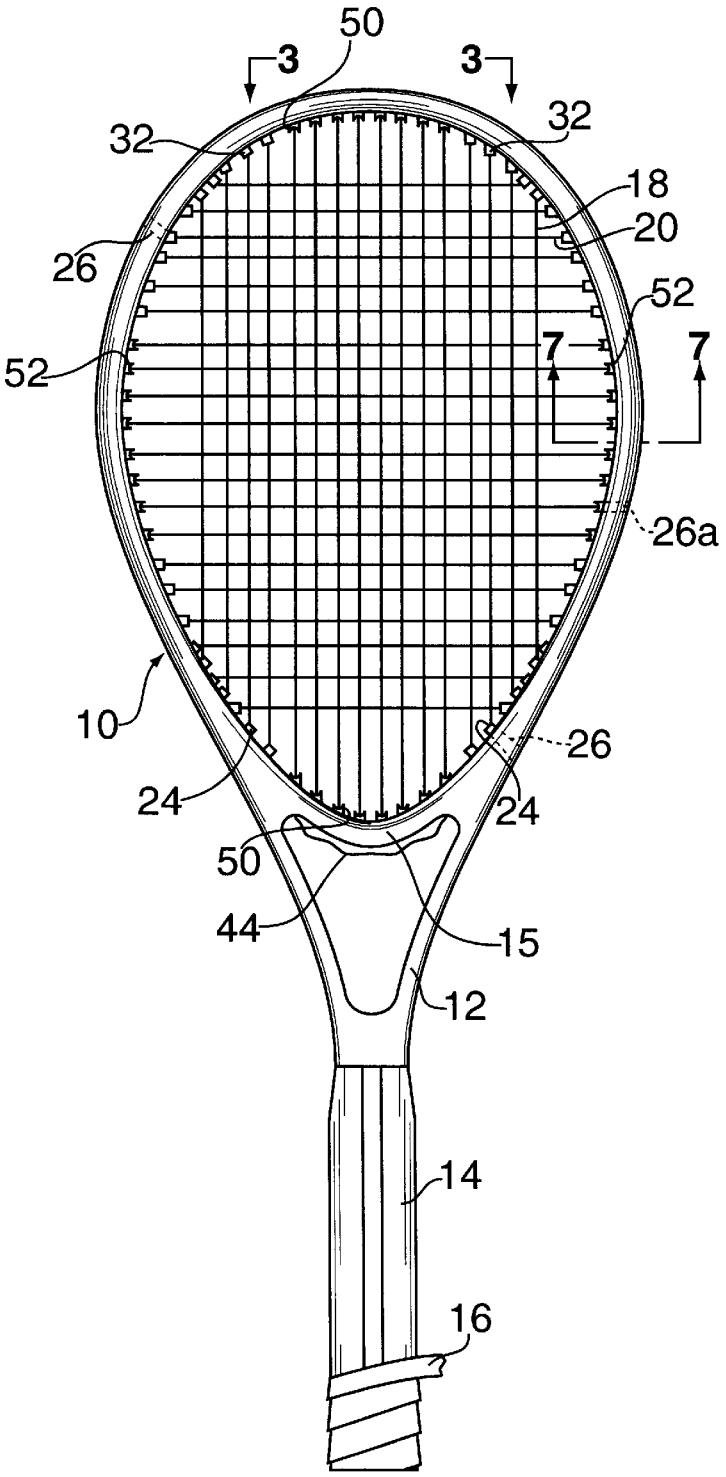
FIG. 1 is a front view of a tennis racquet having notched, slotted grommets according to the invention.
Figure 2:
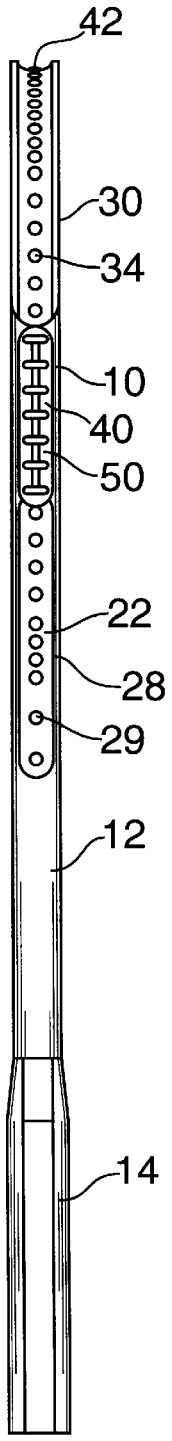
FIG. 2 is a side view of the racquet, in which the strings have been omitted for clarity.

A tennis racquet includes a frame defining a head portion 10, a pair of converging shafts 12 forming a throat region, and a handle 14 wrapped by a grip 16. A throat bridge 15 spans the upper ends of the shafts 12 to complete an egg shaped stringing area containing a plurality of interwoven main strings 18 and cross-strings 20.

The opposed sides of the racquet each include a grommet strip 22, which is conventional except for its length, having a plurality of grommet pegs 24 that extend through string holes 26*a* formed in the head portion 10 of the frame. The grommet strips 22 lie in a stringing groove 28 formed on the outwardly facing surface of the frame head portion 10 in the customary manner, and each grommet peg 24 includes a grommet hole 29 through which a string 18 or 20 is passed.

The tip of the frame portion 10 includes a bumper strip 30, which is conventional except as described below, and which, similar to the grommet strips 22, includes a plurality of grommet pegs 32, having grommet holes 34, that extend through string holes 26 formed in the frame head portion 10.

The central region of the sides of the head portion 10 includes grommet members 40 which, as described below, have notched, slotted grommet pegs 52 in place of conventional grommet pegs 24. Similarly, the center of the tip region and the throat bridge 15 utilize grommet members 42 and 44, respectively, which similarly use notched, slotted grommet pegs 52 in place of conventional grommet pegs.

Figure 4:
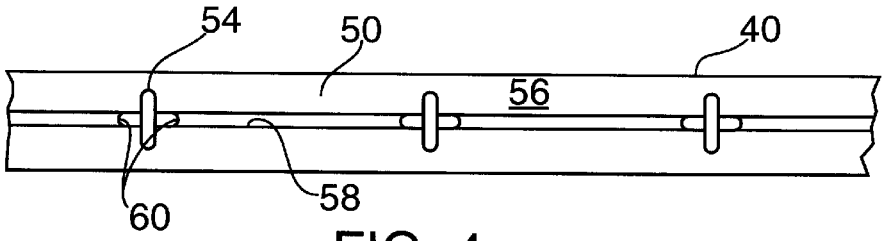
FIGS. 4–6 are top, side, and bottom views, respectively, of a grommet member used in the racquet of FIGS. 1–2.
Figure 5:
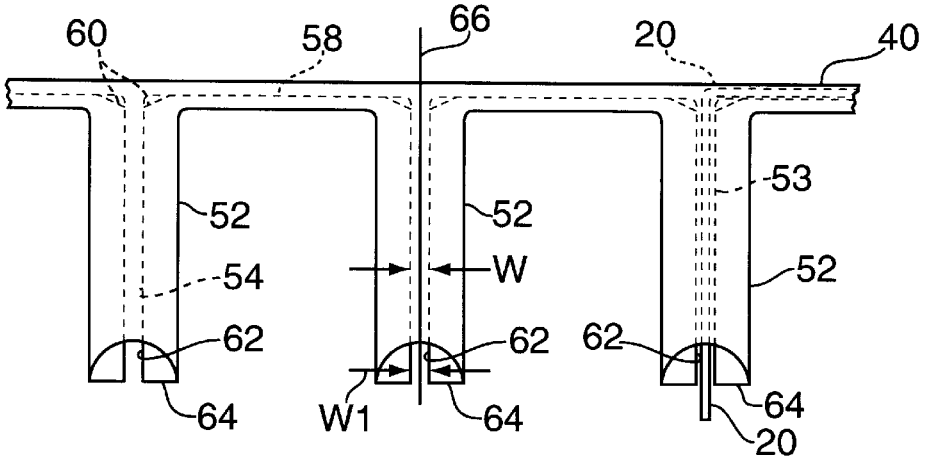
Figure 6:
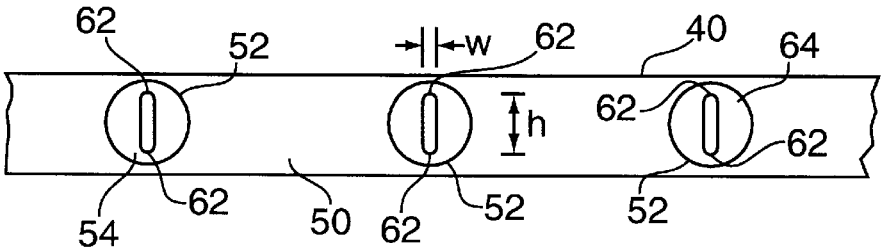
Figure 7:
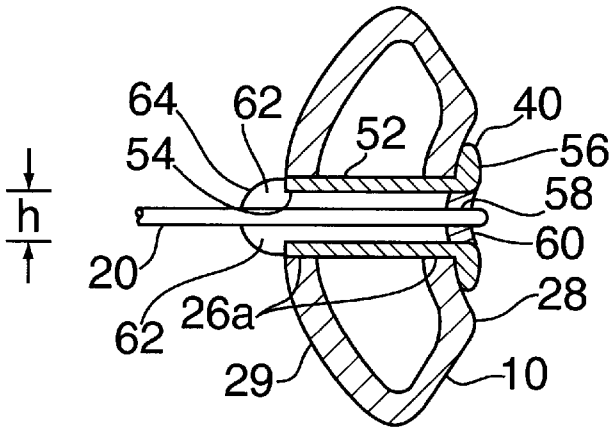
FIG. 7 is a cross-sectional view of the racquet frame, taken in the direction of lines 7—7 of FIG. 1.

FIGS. 4–6 show enlarged views of the grommet member 40, which includes a grommet strip portion 50 and a plurality of grommet pegs 52 depending therefrom. As shown in FIG. 6, the grommet pegs 52 are round in cross-section, and have slotted grommet holes 54 therethrough that have a height "h", in the direction perpendicular to the string bed, which is greater than their width "w". As shown in FIGS. 5 and 7, the height "h" and width "w" of the grommet holes 54 are constant along their length.

Preferably, the outwardly facing surface 56 of the grommet strip portion 50 includes a string guide groove 58 connecting the string holes 54 for locating the positions of the strings. Preferably also, the string guide grooves 58 have a concave lip 60 adjacent the entrance to the string holes, both to provide a more gradual curvature for the string when entering and leaving the string hole, but also act as a string guide to hold the tensioned string against movement perpendicular to the string bed at a point just outside the string hole.

As shown in FIGS. 5–6, each grommet peg 52 has a pair of opposed top and bottom notches 62 extending from the distal end 64 of the grommet peg 52 towards the grommet strip portion 50. The notches 62 lie in a plane lying perpendicular to the string bed and containing the grommet peg central axis 66. The notches have a width "w1" which is preferably the same as the width of the grommet hole.

FIG. 7 shows the grommet member 40 secured in a string hole 26*a* of a racquet frame head portion 10. In the example, the head portion 10 is a composite (e.g., "graphite") frame, formed of a hollow tubular member to have an outwardly facing stringing groove 28. The string hole 26*a* is drilled through the wall forming the stringing groove 28 and also through the opposed wall 29 facing the inside of the frame. The grommet strip portion 50 rests in the stringing groove 28, such that the grommet pegs 52 extend through the string holes 26*a*.

As can be seen in FIG. 7, a cross string 20 extends along the outside surface 56 of the grommet member 40, in the string guide groove 58, curves around the concave lip 60, and thereafter enters the grommet string hole 54 where it passes from the outside of the head to the inside of the strung surface. As shown by FIG. 7, the grommet hole 54 has a constant height which is substantially larger than the diameter of the string 20, such that the string has freedom of movement in the direction of "h", i.e., perpendicular to the string bed.

As can be seen from FIGS. 5 and 7, in the preferred embodiment the distal end 64 of the grommet pegs 52 are rounded, when viewed in the plane of the strings and perpendicular to the grommet hole axis 66, such that the distal end 64 projects furthest in the center region of the slot. However, if desired, the distal end 64 can be rectangular in cross-section rather than rounded.

The string 20 is constrained against movement by the string guide groove 58 and lip 60. The extent to which the string 20 can move up or down within grommet hole 54 would normally be determined by the height "h" of the grommet string hole 54 at the distal end of the grommet hole 54. However, due to the notches 62, the string 20 is able to move a greater distance in the direction of its height "h" before striking the top or bottom wall of the grommet hole 54.

As shown in FIG. 5, after the string 20 extends along the string guide groove 58 and enters the grommet hole 54, it tends to hug one sidewall 53, namely, the sidewall in the direction of where the string entered the hole 54. As such, when a ball impacts the string bed, the fact that the string hole 54 has a width greater than the string diameter allows the string to deflect freely in a direction perpendicular to the string bed, i.e., toward one of the notches 62, but after the ball leaves the strings the rubbing between the string 20 and sidewall 53 creates friction and thereby dampens string vibration.

Figure 3:
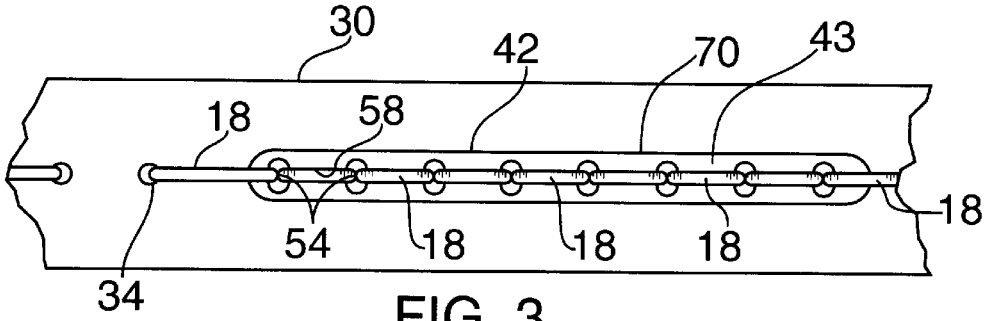
FIG. 3 is a top view of a portion of the racquet, looking in the direction of arrows 3—3 of FIG. 1.

The grommet member 42 used in the tip is shown in FIG. 3. It has the same construction as grommet member 40, except that, in the example, it includes eight (8) notched, slotted grommet pegs, with slotted grommet holes 54, rather than the seven grommet pegs of grommet member 40 (meaning that the length of grommet strip portion 43 may be different than grommet strip portion 50), and the spacing between grommet pegs is different (as dictated by the spacing between adjacent strings).

The tip region includes a bumper strip 30 that is conventional except that it includes a cutout 70, centered about the racquet axis, for containing the grommet member 42. The portion of the conventional bumper strip 30 that would otherwise fill cutout 70 is removed, along with the eight conventional grommet pegs that would otherwise occupy such region, and are replaced by grommet member 42 with notched, slotted grommet pegs 50.

Figure 8:
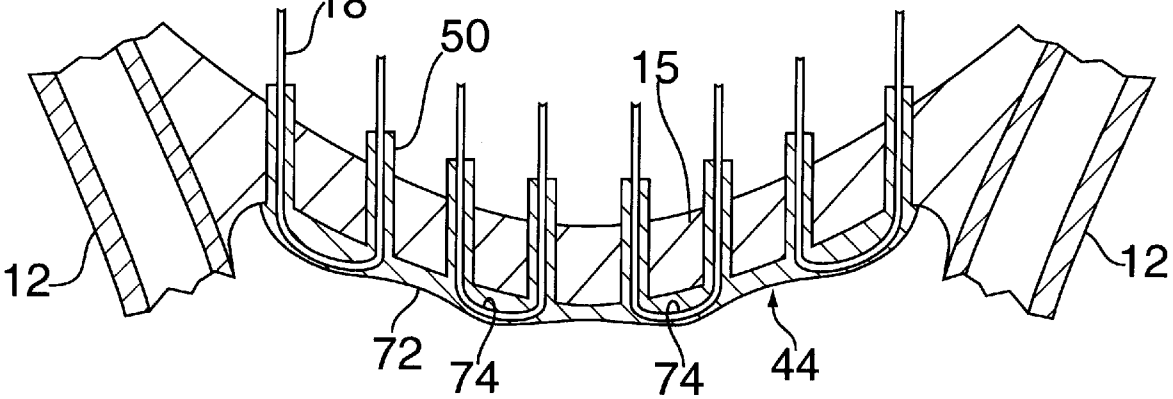
FIG. 8 is a horizontal sectional view of the throat bridge of the racquet of FIG. 1.

Grommet member 44 is similar to grommet members 40 and 42 and is shown in FIG. 8. Like members 40 and 42, grommet member 44 has a grommet strip portion 72 and a plurality of notched, slotted grommet pegs 50, that are preferably identical to the grommets pegs 50 used in members 40, 42. As shown in FIG. 8, the grommet strip portion 72 differs from the grommet strip portions 50 and 43 in that, owing to the fact that at the throat bridge there is no need to restrict the height of the strip 72, i.e., to keep it from extending above the top edges of a string groove, the string guide grooves 74 have an outside surface that is curved along the axis of the strip 72.

In a preferred embodiment, the grommet member 40 extends only along the central region of the sides of the frame head portion 10. In the example of a tennis racquet shown, the grommet member 40 includes seven (7) grommet pegs, but the most desirable number of grommet pegs for any given racquet can vary depending upon a number of factors, such as head size, curvature, and the desired performance and feel for the racquet. Preferably, between four (4) and fourteen (14) notched, slotted grommet pegs are used along each side of the head, and conventional grommet pegs are provided in the remainder of the sides. Alternatively, all of the string holes may contain notched slotted grommets. The reason, however, that the exemplary embodiment preferably does not utilize slotted grommets in the corners has to do with the way string holes are drilled.

Conventionally, string holes are drilled through frame so as to extend perpendicular to the tangent of the frame, such that the tension force of the strings is applied to the frame normal to its axis. This means that, in the center regions of the string bed (which means the center of the sides of the frame as well as the tip region and throat bridge), the string holes are generally aligned with the direction of the strings as they traverse the string bed. However, above and below the central region, due to racquet curvature, the string holes lie at an angle relative to the direction of the strings within the string bed. Thus, except in the central regions of the string bed, the portion of the string within the grommet hole extends at one angle, and crosses the string bed at a different angle, meaning that it has to bend as it leaves the grommet hole. The bend angle is relatively severe in the corners of the racquet head.

Thus, even if notched, slotted grommet pegs were to be provided outside the center regions, they would be less effective, due to the friction against the side of the grommet hole at the point where the strings exit the grommet hole and sharply bend.

In accordance with the invention, the strings that engage grommet members 40, 42, 44 are supported only at locations outside of the racquet frame proper, therefore increasing the effective length of the strings 18, 20 by twice the width of the racquet frame, e.g., an increase ranging between 16 mm and 28 mm. This results in an effective increase in the string length of 6%–10%, depending upon the size of the head and width of the racquet frame. Therefore, when a ball impacts the string bed in a racquet according to the invention, the strings will pivot about their support point along the outer string groove and have freedom of movement within the slotted grommet.

As noted before, the height of the slot is a limiting factor as to the angle through which the string can pivot. Once the string hits the top or bottom of the slot, further bending will be about the point where the string contacts the top or bottom surface of the slot, thereby reducing the effective string length to that of a conventional string mounting.

The angle through which a string will try to deflect due to ball impact varies based on a number of factors such as string tension, string pattern, string gauge, ball hit location, ball speed, and swing speed. In order to accommodate all variables to prevent contact between the strings and the top and bottom of the grommet hole, the grommet pegs, and thereby the racquet string holes, would need to have a very large diameter. This is impractical because a larger string hole severely reduces the structural integrity of the racquet.

In the preferred embodiment the grommet pegs 50 have an outside diameter of 5–6 mm, as opposed to approximately 4 mm for conventional grommet pegs. Although the grommet pegs 50 of the present invention are somewhat larger than conventional grommet pegs 24, and therefore require somewhat larger string holes 26*a* in the racquet frame head 10, the notches 62 formed in the ends of the grommet pegs, by increasing the angle through which the strings can move, allows the diameter of the grommet to be reduced, while maintaining a generous allowance for out-of-plane string deflection.

Preferably, the two opposed side walls of the grommet holes 54 are spaced apart a distance slightly greater than the diameter of the string. The spacing chosen should be sufficient to ensure that string deflection upon ball impact is not restricted. As noted before, even though the sidewalls are spaced wider than the string, the string tends to hug one sidewall, and therefore after the ball leaves the string bed the string will rub against the sidewall and dampen vibration. Vibration damping is most effective in the region of the notches, where string movement due to vibrations is greatest.

In addition to the aforementioned advantages, it has been found that the large opening provided by the slotted grommet holes reduces the whistling sound that tennis racquets normally make during a swing. Racquets can travel through the air at very high speeds, especially on serves, and an aerodynamic effect occurs when the air passes over the racquet and draws air through the grommet. If the grommet has a small hole, or a large opening at one end converging into a small hole at the other end, a whistling sound can be heard. These whistling sounds are often a distraction to tennis players.

The foregoing represents preferred embodiments of the invention. Variations and modifications will be apparent to persons skilled in the art, without departing from the inventive concepts disclosed herein. For example, grommet members may, if desired, be used around the entire frame, notwithstanding the fact that, in regions other than the center regions, string movement perpendicular to the string bed would be inhibited due to the fact that the strings bend around the inside edge of the grommet peg as they enter the string bed. However, if the cross string holes were to be drilled perpendicular to the racquet axis, i.e., in the direction of the cross-strings, rather than normal to the outside of the frame as is normally done, and the main string holes were to be drilled axially, i.e., in the direction of the main strings, it would then be most preferred to utilize the present grommet member for all the strings. All such modifications and variations are intended to be within the skill of the art, as defined in the following claims.

I claim:

1. A grommet for a sports racquet comprising:

a mounting portion for engaging an outside surface of a string hole;

a grommet peg having a first end extending from said mounting portion along an axis and a distal end opposite said first end, said mounting portion and said grommet peg having an axially oriented grommet hole therethrough extending from said mounting portion to said distal end, wherein at least a part of said grommet hole, extending from said distal end towards said first end, has a cross-section that, in a first direction, is substantially larger than the diameter of a standard sports racquet string, and wherein said grommet peg has a pair of opposed notches extending from said distal end towards said first end, wherein said notches lie in a plane formed by said axis and first direction and have a width which is at least substantially that of such standard racquet string.

2. A grommet according to claim 1, wherein said mounting portion has an outside surface, and guide means on said outside surface, adjacent said grommet hole, for securing a tensioned string that enters said grommet hole from movement in a direction perpendicular to said grommet hole.

3. A grommet according to claim 1, wherein said grommet hole has a pair of opposed sidewalls, extending parallel to said first direction, which are spaced apart a distance slightly greater than such standard racquet string, wherein a tensioned racquet string will tend to bear against one of said sidewalls, and such that said grommet peg, when used on a strung racquet, allows the strings to deflect freely upon ball impact with the string bed, but damp vibration after the ball has left the string bed due to contact between the string and said one sidewall.

4. A grommet member comprising:

a grommet strip portion; and a plurality of grommet pegs, each having a first end extending from said grommet strip portion and a distal end opposite said first end, said mounting portion and said grommet peg having an axially oriented grommet hole therethrough extending in a first direction from said mounting portion to said distal end, wherein said grommet hole, at least along a part of said hole extending from said distal end towards said first end, has a cross-section that, in a first direction, is substantially larger than the diameter of a standard sports racquet string, and wherein said grommet peg has a pair of opposed notches extending from said distal end towards said first end, wherein said notches lie in a plane formed by said bore axis and first direction and have a width which is at least substantially that of such standard racquet string.

5. A grommet member according to claim 4, wherein said grommet hole has a pair of opposed sidewalls, extending parallel to said first direction, which are spaced apart a distance slightly greater than such standard racquet string, wherein a tensioned racquet string will tend to bear against one of said sidewalls, and such that said grommet peg, when used on a strung racquet, allows the strings to deflect freely upon ball impact with the string bed, but damp vibration after the ball has left the string bed due to contact between the string and said one sidewall.

6. A sports racquet comprising:

a frame defining a head portion and having string holes for securing strings;

a grommet member having a grommet strip portion and a plurality of grommet pegs extending though said string holes, wherein said grommet pegs have a first end extending from said grommet strip portion and a distal end opposite said first end, said grommet strip portion and said grommet peg having an axially oriented grommet hole therethrough in a first direction extending from said grommet strip portion to said distal end, wherein said grommet hole, at least along a part of said hole extending from said distal end towards said first end, has a cross-section that, in a first direction, is substantially larger than the diameter of a standard sports racquet string, and wherein said grommet peg has a pair of opposed notches extending from said distal end towards said first end, wherein said notches lies in a plane formed by said axis and first direction and have a width which is at least substantially that of such standard racquet string.

7. A sports racquet according to claim 6, wherein said mounting portion has an outside surface, and guide means on said outside surface, adjacent said grommet hole, for securing a tensioned string that enters said grommet hole from movement in a direction perpendicular to said grommet hole.

8. A grommet according to claim 6, wherein said grommet hole has a pair of opposed sidewalls, extending parallel to said first direction, which are spaced apart a distance slightly greater than such standard racquet string, wherein a tensioned racquet string will tend to bear against one of said sidewalls, and such that said grommet peg, when used on a strung racquet, allows the strings to deflect freely upon ball impact with the string bed, but damp vibration after the ball has left the string bed due to contact between the string and said one sidewall.

9. A sports racquet comprising:

a frame including a head portion with an outwardly facing surface and an inwardly facing surface which defines a stringing area, and further including string holes which extend from said outwardly facing surface to said inwardly facing surface;

a grommet member comprising a grommet strip contacting at least a portion of said outwardly facing surface and having an outer grommet surface, and a plurality of grommet pegs, having grommet holes, spaced along said grommet strip and extending into a series of adjacent string holes, wherein each said grommet hole has an axis and a cross-section which, along its entire length, is substantially greater in a direction perpendicular to the stringing plane than the diameter of a standard sports racquet string; and a string including first string portions which extend through said grommet holes, second string portions which extend from said first string portions into said stringing area, to form at least part of a string bed, and connecting portions which extend along said outer grommet surface between grommet holes;

wherein said outer grommet surface includes a groove which seats said connecting portions for securing said connecting portions against movement in a direction perpendicular to the string bed; wherein said grommet holes are configured to allow said first string portions to deflect freely, in response to ball impact on the string bed, in a direction perpendicular to the string bed, so that said string is constrained against movement only on the exterior of said grommet hole and said first string portions can deflect along their entire lengths, and wherein each said grommet hole includes a grommet wall portion located in the region of said head portion inwardly facing surface, wherein said grommet wall portion has an at least essentially flat surface perpendicular to the string bed and parallel to the respective grommet hole axis, and wherein said first string portions bear against said grommet wall portions, whereby said wall portions allow each said first string portion to deflect freely, in response to the force of ball impact, in a direction perpendicular to the stringing plane but which, after ball impact, create sufficient friction to damp string vibrations.

10. A sports racquet comprising:

a frame including a head portion with an outwardly facing surface and an inwardly facing surface which defines a stringing area, and further including string holes which extend from said outwardly facing surface to said inwardly facing surface;

a grommet member comprising a grommet strip contacting at least a portion of said outwardly facing surface and having an outer grommet surface, and a plurality of grommet pegs, having grommet holes with inner and outer ends, spaced along said grommet strip and extending into a series of adjacent string holes; wherein each said grommet hole includes a pair of opposed, at least essentially flat, sidewalls which extend from said outer end to said inner end of said grommet hole, and wherein said sidewalls have a dimension in a direction perpendicular to the stringing plane, which is substantially greater than the diameter of a standard sports racquet string and are spaced apart a distance greater than the diameter of a standard sports racquet string, a string including first string portions which extend through said grommet holes, second string portions which extend from said first string portions into said stringing area, to form at least part of a string bed, and connecting portions which extend along said outer grommet surface between grommet holes, wherein said outer grommet surface includes a groove which seats said connecting portions for securing said connecting portions against movement in a direction perpendicular to the string bed, wherein each first string portion bears against one of the two sidewalls only of the respective grommet hole through which it passes, wherein said string is constrained only on the exterior of said grommet hole such that said first string portions can deflect along their entire lengths, whereby said sidewalls allow said first string portion to deflect freely, in response to the force of ball impact, in a direction perpendicular to the stringing plane but which, after ball impact, create sufficient friction to damp string vibrations.

* * * * *